US010158185B2

(12) United States Patent
Scherer et al.

(10) Patent No.: US 10,158,185 B2
(45) Date of Patent: Dec. 18, 2018

(54) CONNECTOR ASSEMBLY

(71) Applicant: 3M INNOVATIVE PROPERTIES COMPANY, St. Paul, MN (US)

(72) Inventors: Richard J. Scherer, Austin, TX (US); Abhay R. Joshi, Austin, TX (US); William J. Lee, Cedar Park, TX (US); Joseph N. Castiglione, Cedar Park, TX (US); Jesse A. Mann, Cedar Park, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/561,241

(22) PCT Filed: Apr. 26, 2016

(86) PCT No.: PCT/US2016/029364
§ 371 (c)(1),
(2) Date: Sep. 25, 2017

(87) PCT Pub. No.: WO2016/178861
PCT Pub. Date: Nov. 10, 2016

(65) Prior Publication Data

US 2018/0054011 A1 Feb. 22, 2018

Related U.S. Application Data

(60) Provisional application No. 62/155,599, filed on May 1, 2015.

(51) Int. Cl.
*H01R 12/75* (2011.01)
*H01R 12/53* (2011.01)
(Continued)

(52) U.S. Cl.
CPC ..... *H01R 12/75* (2013.01); *H01R 12/53* (2013.01); *H01R 12/585* (2013.01);
(Continued)

(58) Field of Classification Search
CPC ..... H01R 12/75; H01R 12/53; H01R 12/585; H01R 12/7005
(Continued)

(56) References Cited

U.S. PATENT DOCUMENTS 4,262,983 A * 4/1981 Bogese, II ..... H01R 12/585 439/424
4,857,012 A * 8/1989 Yard ..... H01R 13/516 439/445
(Continued)

FOREIGN PATENT DOCUMENTS

EP 2453526 5/2012
WO WO 2015-017298 2/2015

OTHER PUBLICATIONS

International Search Report for PCT International Application No. PCT/US2016/029364, dated Aug. 2, 2016, 4pgs.

*Primary Examiner* — Alexander Gilman
(74) *Attorney, Agent, or Firm* — Clifton F. Richardson

(57) ABSTRACT

A connector assembly for electrically connecting a plurality of wires to a circuit board is described. The connector assembly includes a vertical connector that includes an insulative base having pluralities of substantially parallel first and second base channels formed on respective opposing first and second major surfaces of the base. The vertical connector further includes pluralities of first and second terminals in registration with the respective first and second base channels, each first and second terminal including a contact portion for making contact with a wire, and a press-fit portion for being inserted into a conductive via of a circuit board. At least a majority length of each first and
(Continued)

second terminal is disposed outside the housing. Each first and second terminal is secured in the connector at least in part by virtue of making physical contact with a corresponding wire.

8 Claims, 7 Drawing Sheets

(51) Int. Cl.
*H01R 12/58* (2011.01)
*H01R 13/518* (2006.01)
*H01R 12/70* (2011.01)
*H01R 12/71* (2011.01)

(52) U.S. Cl.
CPC ..... *H01R 12/7005* (2013.01); *H01R 12/716* (2013.01); *H01R 13/518* (2013.01)

(58) Field of Classification Search
USPC ..... 439/63
See application file for complete search history.

(56) References Cited

U.S. PATENT DOCUMENTS 5,435,744 A * 7/1995 Derstine ..... H01R 13/5045 439/352
5,910,031 A * 6/1999 Goto ..... H01R 12/515 439/329
6,380,485 B1 * 4/2002 Beaman ..... H01R 9/035 174/88 R
7,422,490 B2 * 9/2008 Droesbeke ..... H01R 13/514 439/701
8,911,255 B2 * 12/2014 Scherer ..... H01R 23/10 439/607.07
9,118,147 B1 * 8/2015 Sharf ..... H01R 12/7082
9,325,082 B2 * 4/2016 Furukawa ..... H01R 4/188
2003/0040203 A1 * 2/2003 Kuroda ..... H01R 4/185 439/98
2004/0185707 A1 * 9/2004 Holliday ..... H01R 9/0518 439/491
2006/0089046 A1 * 4/2006 Annequin ..... H01R 43/048 439/578
2009/0098769 A1 * 4/2009 Sakamoto ..... H01R 4/184 439/578
2010/0267252 A1 * 10/2010 Fujimoto ..... H01G 2/06 439/55
2012/0108083 A1 * 5/2012 Wittig ..... H01R 4/184 439/78
2013/0224997 A1 * 8/2013 Miyawaki ..... H01R 4/184 439/585
2014/0349513 A1 * 11/2014 Mathews ..... H01R 12/675 439/470
2014/0370734 A1 * 12/2014 Mathews ..... H01R 13/629 439/157

* cited by examiner

CONNECTOR ASSEMBLY

BACKGROUND

Coaxial cables may be attached to a circuit board by various methods. Such methods may include soldering the cable directly to the circuit board, using RF (radio frequency) style connectors, or attaching the cable to a paddle card which mates with the circuit board.

SUMMARY

In some aspects of the present description, a connector assembly for electrically connecting a plurality of wires to a circuit board is provided. The connector assembly includes a vertical connector that includes an insulative housing having a cable receiving face and an opposite mounting face for mounting the vertical connector onto a circuit board. The housing includes an insulative base including pluralities of substantially parallel first and second base channels formed on respective opposing first and second major surfaces of the base. The vertical connector further includes pluralities of first and second terminals in registration with the respective first and second base channels, each first and second terminal including a contact portion for making contact with a wire, and a press-fit portion for being inserted into a conductive via of a circuit board. At least a majority length of each first and second terminal is disposed outside the housing beyond the mounting face. The connector assembly further includes a plurality of first wires, each first wire disposed in a corresponding first base channel and terminated at the contact portion of a corresponding first terminal; and a plurality of second wires, each second wire disposed in a corresponding second base channel and terminated at the contact portion of a corresponding second terminal. Each first and second terminal is secured in the connector at least in part by virtue of making physical contact with a corresponding wire.

DETAILED DESCRIPTION

In the following description, reference is made to the accompanying drawings that forms a part hereof and in which are shown by way of illustration. The drawings are not necessarily to scale. It is to be understood that other embodiments are contemplated and may be made without departing from the scope or spirit of the present disclosure. The following detailed description, therefore, is not to be taken in a limiting sense.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

Connector assembles according to the present description allow a plurality of wires to be electrically connected to a circuit board. The plurality of wires may be, for example, wires in an electrical ribbon cable (e.g., a coaxial ribbon cable), such as twin axial cables available from 3M Company (St. Paul, Minn.). Connector assemblies of the present description include connectors in which one or more terminals are secured in the connector at least in part by virtue of making physical contact with corresponding one or more wires of the connector assembly. For example, each terminal may be attached to a wire in the connector assembly and this attachment may hold, or help hold, the terminal in place at a mating surface of the connector. The terminals may be attached to the wires by any known attachment method such as solder, ultrasonic, induction, or crimp attachment. The connector assemblies may include a vertical connector having an insulative housing which includes an insulative base and may also include first and second insulative covers, which may be used to hold the wires in place in the insulative base. The connector assemblies may be attached to a circuit board to provide a separable electrical connection.

Figure 1A:
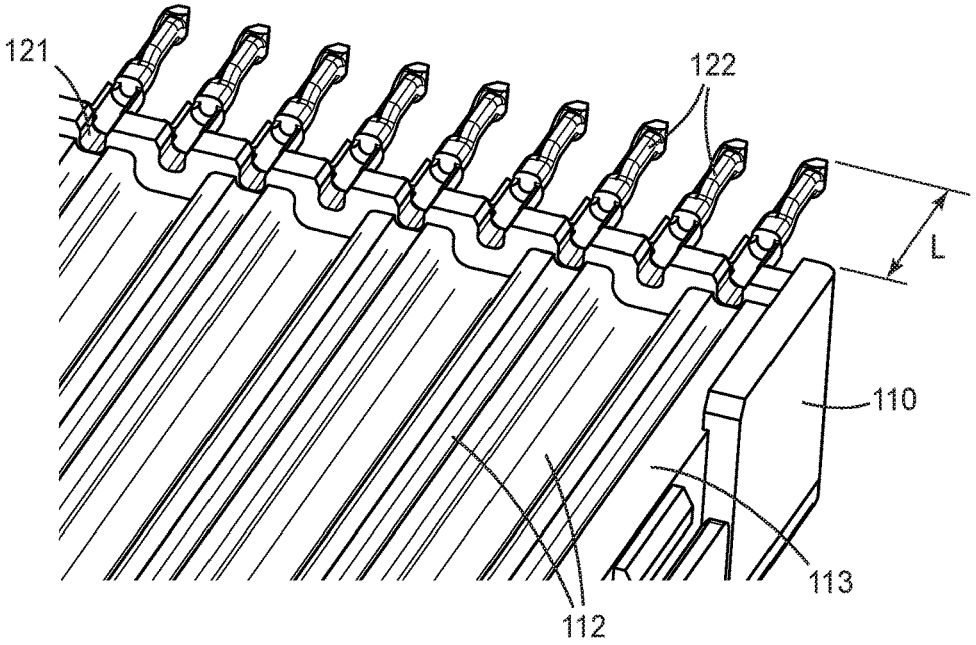
FIG. 1A is a top perspective view of a portion of a connector.
Figure 1B:
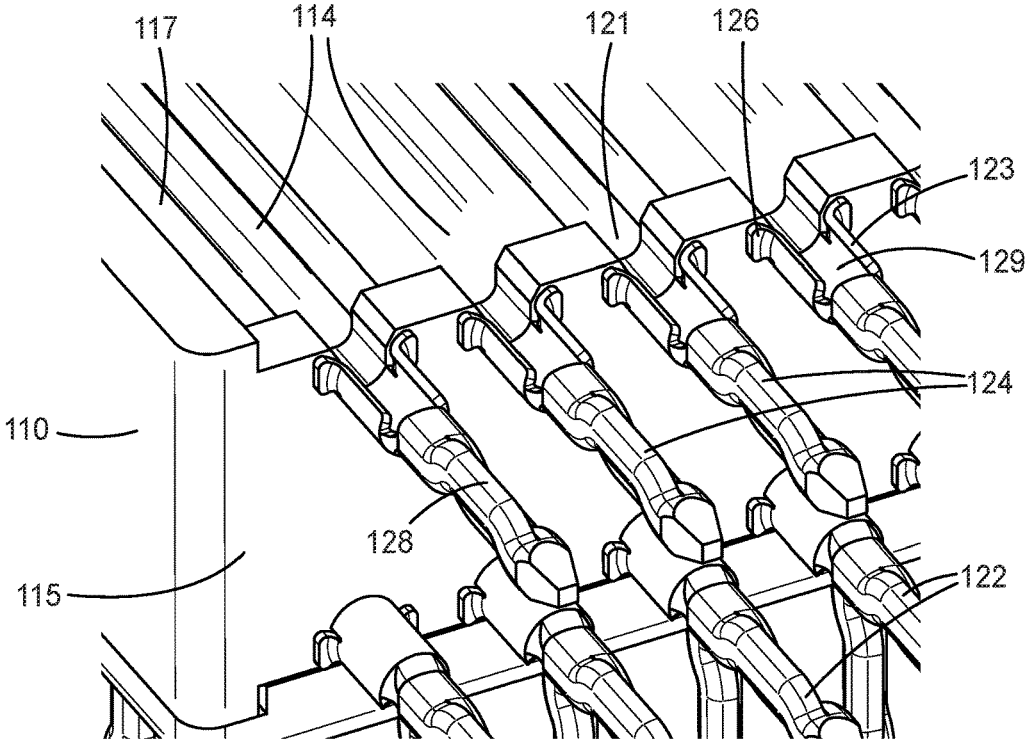
FIG. 1B is a front perspective view of a portion of the connector of FIG. 1A.

FIGS. 1A and 1B are top perspective and bottom-front perspective views of a portion of a connector including insulative base 110 having first and second base channels 112 and 114 formed on respective opposing first and second major surfaces 113 and 117. The connector also includes pluralities of first and second terminals 122 and 124 in registration with the respective first and second base channels 112 and 114 and disposed at exit openings 121. Each terminal having a length L and including a contact portion 123 for making contact with a wire, and a press-fit portion 128 for being inserted into a conductive via of a circuit board. The contact portion 123 may also include a groove portion 129 for receiving an end portion of a corresponding wire. The groove portion 129 may terminate in one or more shoulder portions 126 which extend laterally and rests on a mounting face of the housing. Although not illustrated in FIGS. 1A-1B, the connector assembly would typically include wires disposed in the first and second base channels 112 and 114 that are attached to first and second terminals 122 and 124. In some embodiments, wires attached to the first and second terminals 122 and 124 would hold the terminals in place or contribute to holding the terminals in place. As described elsewhere herein, covers may be applied to the insulative base 110. The covers may help keep the wires and terminals in position.

The insulative housing, including the insulative base and insulative covers, can be made from any suitable material, such as, for example, insulative polymers. The insulative material used for the insulative housing may be chosen based on processability, mechanical properties, electrical resistivity and/or dielectric properties. Suitable insulative materials includes liquid crystal polymer (LCP), epoxy resins or other electrically insulating resins. The insulative housing, including the insulative base and insulative covers, can be made, for example, by injection molding.

The connector includes face 115 which is a mounting face of insulative base 110, or a mounting face or a portion of a mounting face of an insulative housing that includes insulative base 110. In some embodiments, at least a majority length (a majority of the length L) of each first and second terminal 122 and 124 is disposed outside the housing beyond the mounting face. In some embodiments, a portion of the terminals may be disposed inside the housing. In some embodiments, at least 70 percent, or at least 80 percent, or at least 90 percent of the length of each first and second terminal 122 and 124 is disposed outside the housing beyond the mounting face. In some embodiments, each first and second terminal 122 and 124 is completely outside the housing, and the contact portion 123 of the terminal is perpendicular to and rests on a mounting face of the insulative housing. In the embodiment illustrated in FIGS. 1A-1B, the first and second terminals 122 and 124 are completely outside the insulative base 110 with the contact portion 123 of the terminals perpendicular to and resting on face 115. Any suitable terminals can be used with the connectors of the present description. In some embodiments, the terminals are press-fit terminals which may include compliant pin contacts. Suitable terminal types include straight pin styles and leaf spring styles.

Figure 2:
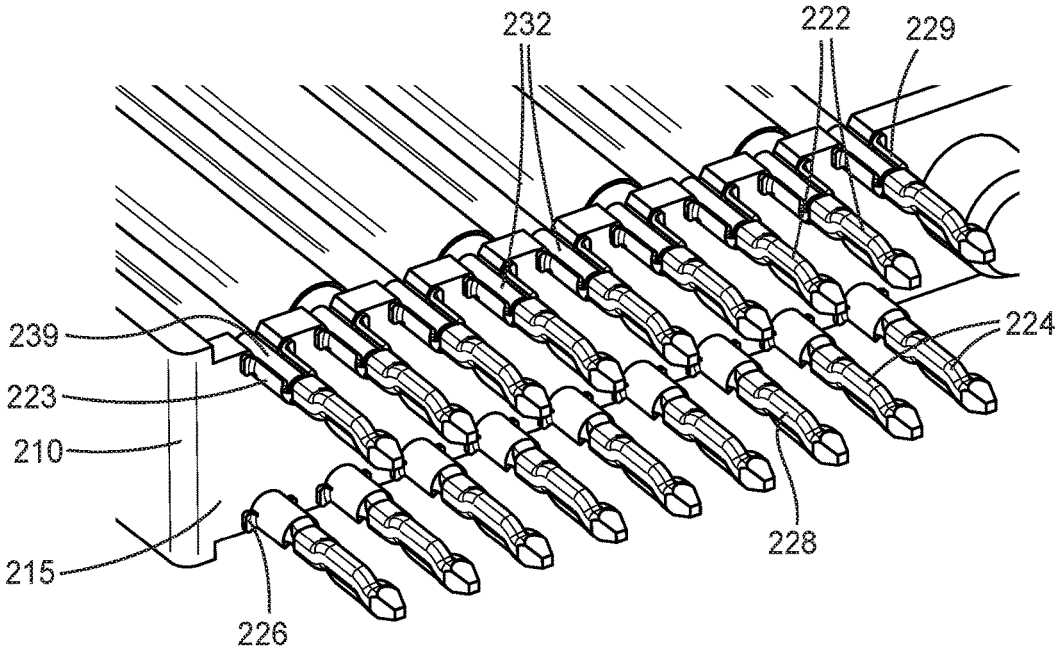
FIG. 2 is a perspective view of a portion of a connector assembly.

FIG. 2 is a perspective top-front view of a portion of a connector assembly including insulative base 210 having face 215, a plurality of first wires 232, and first and second terminals 222 and 224, each terminal including a contact portion 223, shoulder portions 226, a press-fit portion 228 and a groove portion 229. Each first wire 232 is disposed in a first base channel and terminated at a contact portion 223 of a corresponding first terminal 222. An end portion 239 of each first wire 232 may be received in a groove portion 229 of the corresponding first terminal 222. The connector also includes a plurality of second wires (not illustrated), each second wire disposed in a second base channel and terminated at a contact portion 223 of a corresponding second terminal 224. Each first and second terminal 222 and 224 includes shoulder portions 226 which extend laterally and rest on face 215 of insulative base 210, and includes a press-fit portion 228 for being inserted into a conductive via of a circuit board. The first and second terminals 222 and 224 may be held in place at face 215 by being attached to the first wires 232 or to second wires, and the wires may be held in place in the insulative base 210 using first and second covers as described elsewhere herein.

Figure 6:
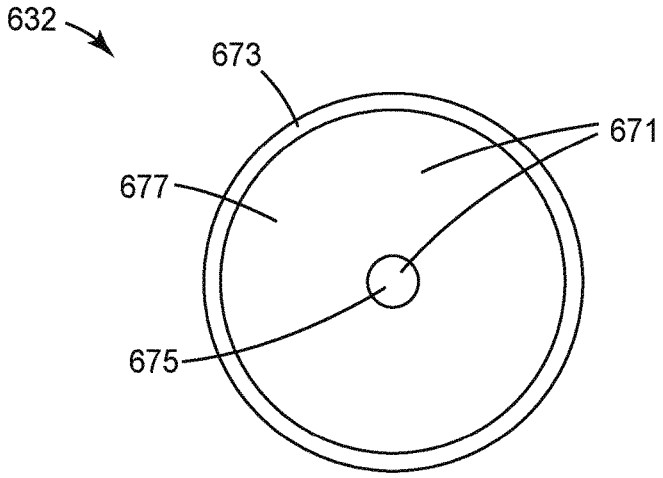
FIG. 6 is a cross-sectional view of a wire.

Any or all of the wires used in the connector assemblies of the present description may include a dielectric material (e.g., polymeric dielectrics) surrounding or substantially surrounding a metallic (e.g., copper) core. Any of the wires used in the connector assemblies of the present description may include a metallic foil coating. A foil coating may be applied to a wire with an adhesive layer between the wire and the foil coating. A metallic foil may be applied to a dielectric layer of a wire with an adhesive layer between the dielectric layer and the metallic foil. In some embodiments, the foil coatings may be electrically grounded. Instead of, or in addition to the adhesive layer, the foil coating may be mechanically bonded to the wire with an ultrasonic weld (e.g., a 40 kHz ultrasonic weld). In some embodiments, a wire may be ultrasonically bonded to a foil and the wire with foil may be used as a drain wire. In some embodiments, a wire with a dielectric layer with a foil coating over the dielectric layer may be used as a signal wire. Configurations that include wires having a metallic core, a dielectric layer and a foil coating, and include wires not including the dielectric layer have been found to enable electronic signaling at high frequencies (e.g., up to 25 GHz). An example wire that is suitable for use in the connector assemblies of the present description is illustrated in FIG. 6, which is a cross sectional view of a wire 632 that may be used as one or more of the first and/or second wires. Wire 632 includes a conductor 671, which may be an insulated conductor, and a metallic foil 673 surrounding or substantially surrounding the conductor 671. The metallic foil 673 may be ultrasonically bonded to conductor 671. In the illustrated embodiment, conductor 671 includes a metallic core 675 and a dielectric layer 677 surrounding the metallic core 675 with the dielectric layer 677, which may be an insulating layer, disposed between the metallic foil 673 and the metallic core 675. In other embodiments, conductor 671 includes a metallic core 675 but no dielectric layer 677 surrounding the metallic core 675.

In some embodiments, the plurality of first wires alternate between wires having a metallic core, a dielectric layer and a foil coating, and wires not including the dielectric layer. Similarly, in some embodiments, the plurality of second wires alternate between wires having a metallic core, a dielectric layer and a foil coating, and wires not including the dielectric layer. In other embodiments, all or none of the wires include a metallic core, a dielectric layer and a foil coating.

Figure 3:
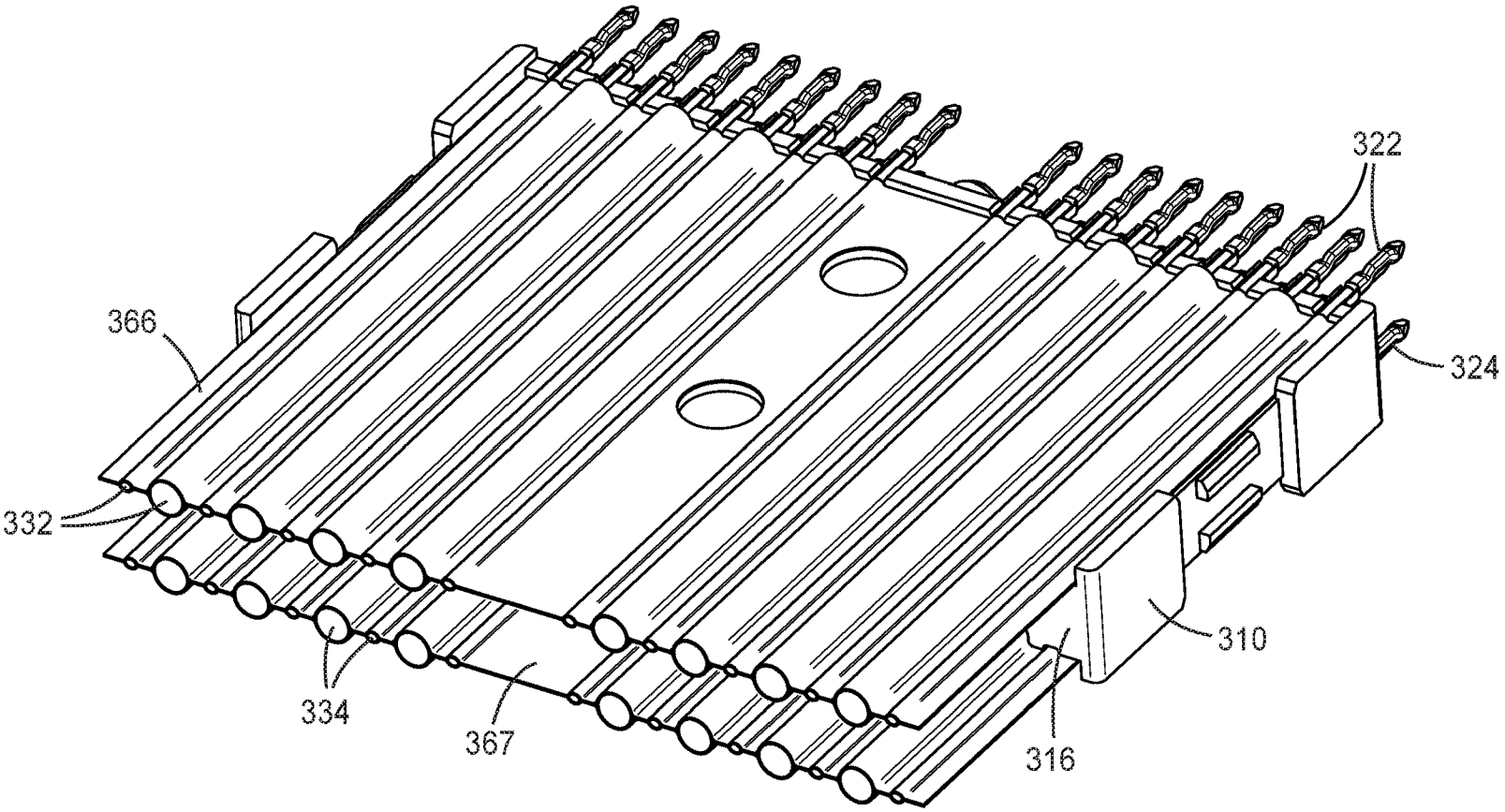
FIG. 3 is a perspective view of a connector assembly.

FIG. 3 is a perspective top view of a connector assembly including insulative base 310, a plurality of first wires 332 and a plurality of second wires 334. First wires 332 are disposed in corresponding first base channels (not illustrated) and second wires 334 are disposed in corresponding second base channels (not illustrated). In FIG. 3, the first and second base channels of insulative base 310, which correspond to the first and second base channels 112 and 114 of FIGS. 1A-1B, respectively, are covered by first and second ribbon cables 366 and 367 which include the pluralities of first and second wires 332 and 334, respectively. First wires 332 are terminated at the contact portions of first terminals 322 and second wires 334 are terminated at the contact portions of second terminals 324. Insulative base 310 includes face 316 which may be a cable receiving face of insulative base 310 for receiving pluralities of first and second wires 332 and 334, or a cable receiving face or a portion of a cable receiving face of an insulative housing that includes insulative base 310.

Figure 4A:
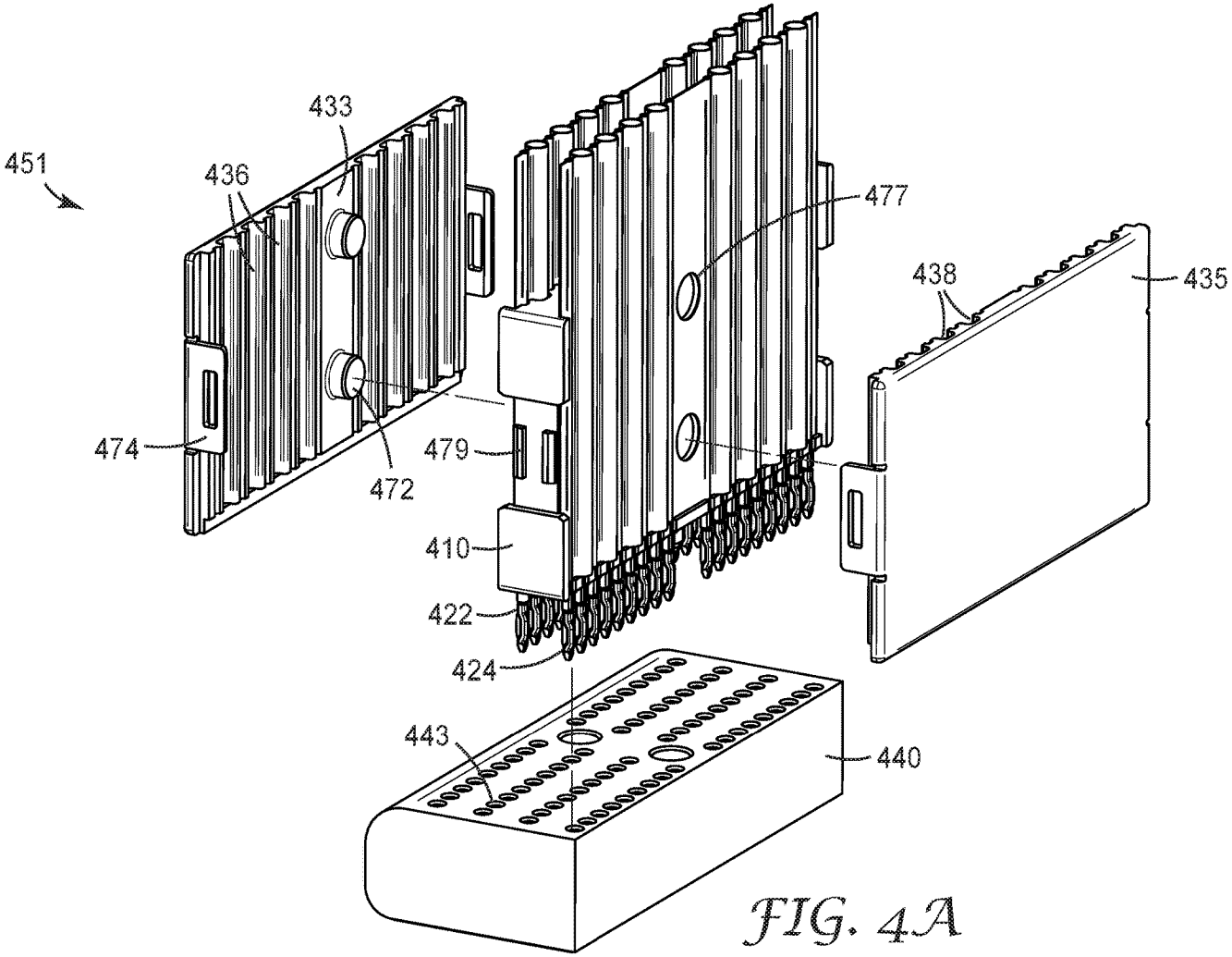
FIG. 4A is an exploded view of a connector assembly.
Figure 4B:
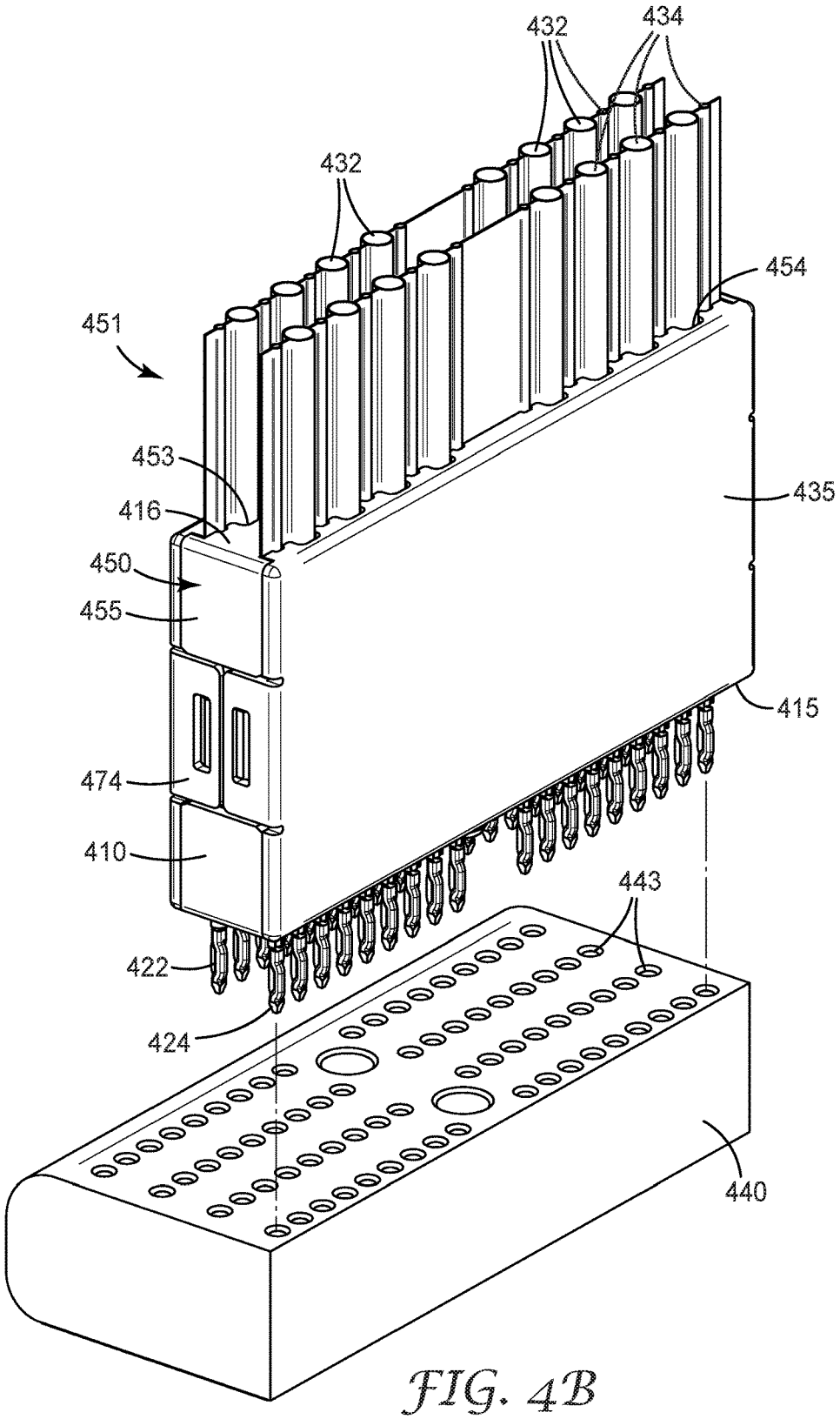
FIGS. 4B-4C are perspective views of the connector assembly of FIG. 4A.
Figure 4C:
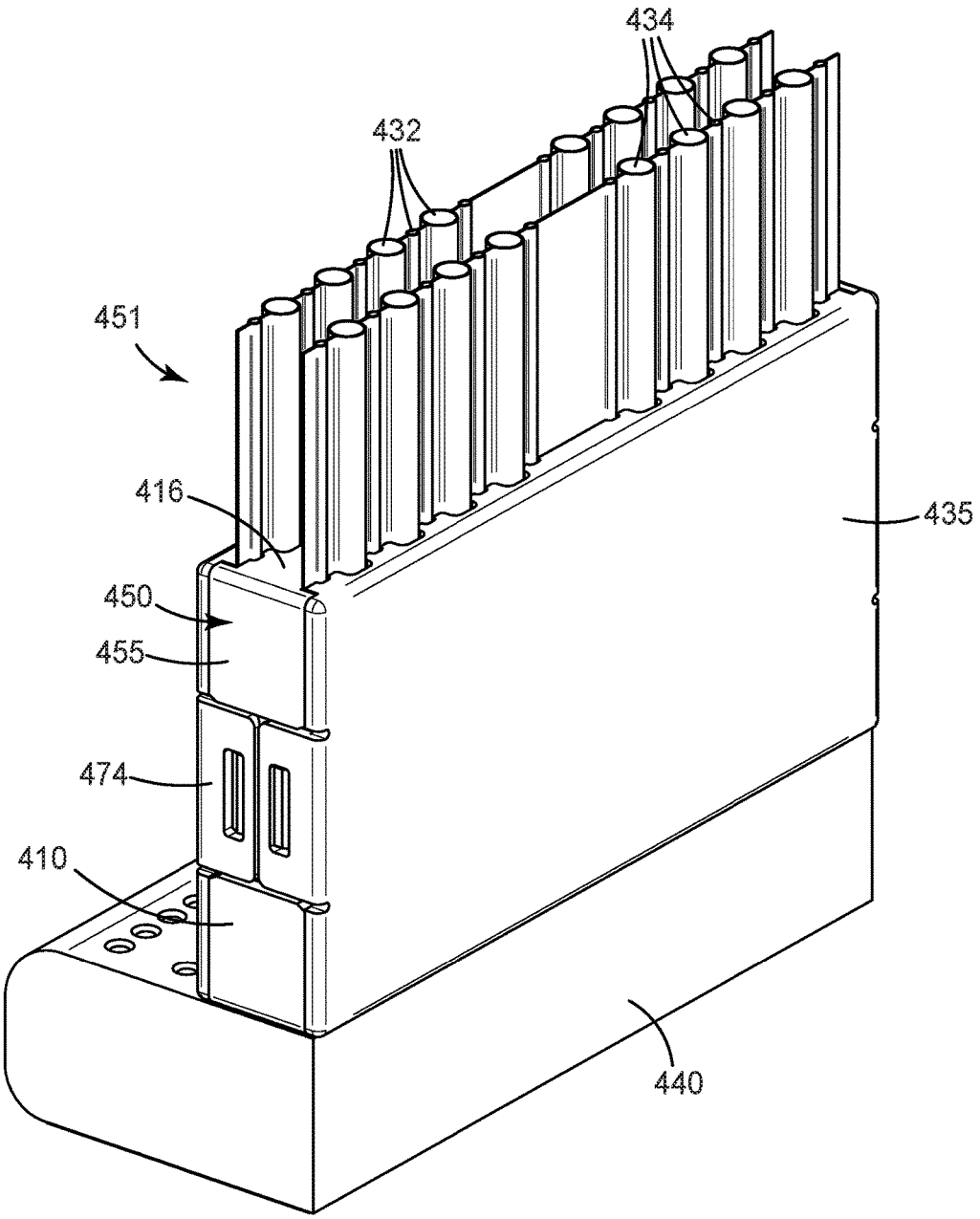

FIG. 4A is an exploded perspective view of connector assembly 451 including insulative base 410, and first and second insulative covers 433 and 435. In FIG. 4A, connector assembly 451 is disposed proximate circuit board 440 that includes vias 443. FIG. 4B is a perspective view of connector assembly 451, including vertical connector 450, disposed proximate circuit board 440, and FIG. 4C is a perspective view of connector assembly 451 connected to circuit board 440. Insulative housing 455 includes the insulative base 410 and the first and second insulative covers 433 and 435. First insulative cover 433 includes a plurality of first cover channels 436 and second insulative cover 435 includes a plurality of second cover channels 438. Insulative base 410 includes a plurality of first base channels (corresponding to first base channels 112) and an opposing plurality of second base channels (corresponding to second base channels 114). Connector assembly 451 includes a plurality of first wires 432 and a plurality of second wires 434. The first insulative cover 433 is assembled to a first major surface of the insulative base 410 and the plurality of first cover channels 436 is in registration with corresponding first base channels, each corresponding pair of first cover channels 436 and first base channels defining a first input opening 453 at the cable receiving face 416 for receiving one or more wires, and a first exit opening (corresponding to an exit opening 121) at the mounting face 415 of the insulative housing 455. The second insulative cover 435 is assembled to a second major surface of the insulative base 410 opposite the first major surface and the plurality of second cover channels 438 is in registration with corresponding second base channels, each corresponding pair of second cover channels 438 and second base channels defining a second input opening 454 at the cable receiving face 416 for receiving one or more wires, and a second exit opening (corresponding to an exit opening 121) at the mounting face of the insulative housing 455. Each first wire 432 is received through a corresponding first input opening 453 and is disposed in a corresponding first cover and base channel, and each first terminal 422 is disposed at a corresponding first exit opening. Each second wire 434 is received through a corresponding second input opening 454 and is disposed in a corresponding second cover and base channel, and each second terminal 424 is disposed at a corresponding second exit opening.

In some embodiments, the first insulative cover 433 includes one or more pegs 472 and insulative base 410 includes one or more corresponding holes 477 for accepting the pegs 472. Such features may be included to aid the proper alignment of the first insulative cover 433 with the insulative base 410. Similarly, in some embodiments, the second insulative cover 435 may include one or more pegs which may be accepted into holes 477 of the insulative base 410. The first and/or second insulative covers may also include latches 474 that mate with corresponding features 479 of the insulative base 410.

Figure 5:
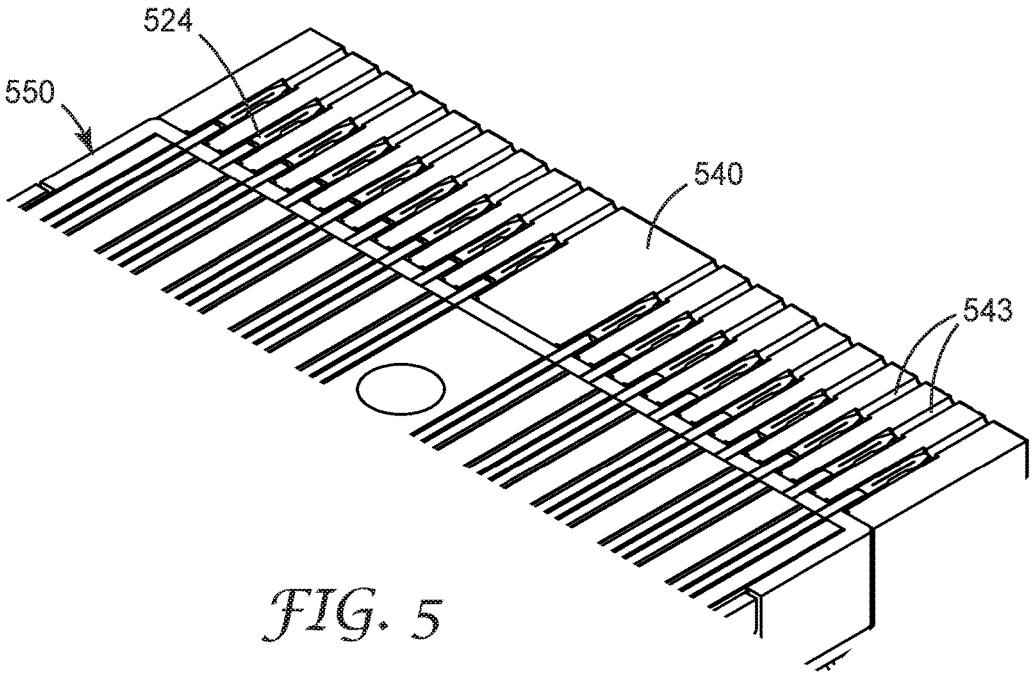
FIG. 5 is a perspective cutaway view of a connector attached to a circuit board.

FIG. 5 is a perspective cutaway view of vertical connector 550 attached to circuit board 540. Vertical connector 550 includes terminals 524 which are inserted into vias 543 of circuit board 540. Vias 543 may be electrically conductive by virtue of conductive features disposed in the vias 543. For example, vias 543 may be plated through-holes having a metallic (e.g., including copper, silver, gold, or PdNi.) plating which contacts terminals 524 when vertical connector 550 is connected to circuit board 540.

The following is a list of exemplary embodiments of the present description.

Embodiment 1 is a connector assembly for electrically connecting a plurality of wires to a circuit board, comprising:

a vertical connector comprising:

an insulative housing having a cable receiving face and an opposite mounting face for mounting the vertical connector onto a circuit board, the housing comprising:

an insulative base comprising pluralities of substantially parallel first and second base channels formed on respective opposing first and second major surfaces of the base; and pluralities of first and second terminals in registration with the respective first and second base channels, each first and second terminal comprising a contact portion for making contact with a wire, and a press-fit portion for being inserted into a conductive via of a circuit board, at least a majority length of each first and second terminal disposed outside the housing beyond the mounting face;

a plurality of first wires, each first wire disposed in a corresponding first base channel and terminated at the contact portion of a corresponding first terminal; and a plurality of second wires, each second wire disposed in a corresponding second base channel and terminated at the contact portion of a corresponding second terminal, each first and second terminal secured in the connector at least in part by virtue of making physical contact with a corresponding wire.

Embodiment 2 is the connector assembly of embodiment 1, wherein each first and second terminal is completely outside the housing, the contact portion of the terminal perpendicular to and resting on the mounting face.

Embodiment 3 is the connector assembly of embodiment 1, wherein the contact portion of each first and second terminal comprises a groove for receiving an end portion of a corresponding wire, the groove terminating in one or more shoulder portions of the contact portion extending laterally and resting on the mounting face of the housing.

Embodiment 4 is the connector assembly of embodiment 1 further comprising:

a first insulative cover assembled to the first major surface of the base and comprising a plurality of first cover channels formed therein in registration with corresponding first base channels, each corresponding pair of first cover and base channels defining a first input opening at the cable receiving face for receiving one or more wires, and a first exit opening at the mounting face, each first wire received through a corresponding first input opening and disposed in a corresponding first cover and base channels, each first terminal disposed at a corresponding first exit opening;

a second insulative cover assembled to the second major surface of the base and comprising a plurality of second cover channels formed therein in registration with corresponding second base channels, each corresponding pair of second cover and base channels defining a second input opening at the cable receiving face for receiving one or more wires, and a second exit opening at the mounting face, each second wire received through a corresponding second input opening and disposed in a corresponding second cover and base channels, each second terminal disposed at a corresponding second exit opening.

Embodiment 5 is the connector assembly of embodiment 1, wherein at least some of the first or second wires comprise a conductor and a metallic foil substantially surrounding the conductor and ultrasonically bonded to the conductor.

Embodiment 6 is the connector assembly of embodiment 5, wherein the conductor comprises a metallic core.

Embodiment 7 is the connector assembly of embodiment 6, wherein the conductor comprises a dielectric layer substantially surrounding the metallic core, the dielectric layer disposed between the metallic foil and the metallic core.

Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A connector assembly for electrically connecting a plurality of wires to a circuit board, comprising:

a vertical connector comprising:

an insulative housing having a cable receiving face and an opposite mounting face for mounting the vertical connector onto a circuit board, the housing comprising:

an insulative base comprising pluralities of substantially parallel first and second base channels formed on respective opposing first and second major surfaces of the base; and pluralities of first and second terminals in registration with the respective first and second base channels, each first and second terminal comprising a contact portion for making contact with a wire, and a press-fit portion for being inserted into a conductive via of a circuit board, at least a majority length of each first and second terminal disposed outside the housing beyond the mounting face, the contact portion of each first and second terminal perpendicular to and resting on the mounting face, the mounting face being an outer face of the insulative housing;

a plurality of first wires, each first wire disposed in a corresponding first base channel and terminated at the contact portion of a corresponding first terminal; and a plurality of second wires, each second wire disposed in a corresponding second base channel and terminated at the contact portion of a corresponding second terminal, each first and second terminal secured in the connector at least in part by virtue of making physical contact with a corresponding wire.

2. The connector assembly of claim 1, wherein each first and second terminal is completely outside the housing.

3. The connector assembly of claim 1, wherein the contact portion of each first and second terminal comprises a groove for receiving an end portion of a corresponding wire, the groove terminating in one or more shoulder portions of the contact portion extending laterally and resting on the mounting face of the housing.

4. The connector assembly of claim 1 further comprising:

a first insulative cover assembled to the first major surface of the base and comprising a plurality of first cover channels formed therein in registration with corresponding first base channels, each corresponding pair of first cover and base channels defining a first input opening at the cable receiving face for receiving one or more wires, and a first exit opening at the mounting face, each first wire received through a corresponding first input opening and disposed in a corresponding first cover and base channels, each first terminal disposed at a corresponding first exit opening, and a second insulative cover assembled to the second major surface of the base and comprising a plurality of second cover channels formed therein in registration with corresponding second base channels, each corresponding pair of second cover and base channels defining a second input opening at the cable receiving face for receiving one or more wires, and a second exit opening at the mounting face, each second wire received through a corresponding second input opening and disposed in a corresponding second cover and base channels, each second terminal disposed at a corresponding second exit opening.

5. The connector assembly of claim 1, wherein at least some of the first or second wires comprise a conductor and a metallic foil substantially surrounding the conductor and ultrasonically bonded to the conductor.

6. The connector assembly of claim 5, wherein the conductor comprises a metallic core.

7. The connector assembly of claim 6, wherein the conductor comprises a dielectric layer substantially surrounding the metallic core, the dielectric layer disposed between the metallic foil and the metallic core.

8. The connector assembly of claim 1, wherein each first and second terminal is secured in the connector by virtue of being attached to the corresponding wire with the contact portion of the terminal resting on the mounting face.

* * * * *